US009532692B2

(12) United States Patent
Curien

(10) Patent No.: US 9,532,692 B2
(45) Date of Patent: Jan. 3, 2017

(54) SUCTION DEVICE DESIGNED TO SUCK AIR AND LIQUID FROM A PLANAR SURFACE, AND SCRAPER BLADE FOR SUCH A DEVICE

(71) Applicant: ECODROP, Chaumousey (FR)

(72) Inventor: Gerard Curien, Housseras (FR)

(73) Assignee: ECODROP, Chamousey (FR)

( * ) Notice: Subject to any disclaimer, the term of this patent is extended or adjusted under 35 U.S.C. 154(b) by 0 days.

(21) Appl. No.: 14/769,498

(22) PCT Filed: Feb. 28, 2014

(86) PCT No.: PCT/FR2014/050450

§ 371 (c)(1),
(2) Date: Aug. 21, 2015

(87) PCT Pub. No.: WO2014/135775

PCT Pub. Date: Sep. 12, 2014

(65) Prior Publication Data

US 2016/0007816 A1 Jan. 14, 2016

(30) Foreign Application Priority Data

Mar. 4, 2013 (FR) ..... 13 51889
Jan. 13, 2014 (FR) ..... 14 50218

(51) Int. Cl.
*A47L 11/40* (2006.01)
*A47L 1/05* (2006.01)

(52) U.S. Cl.
CPC ..... *A47L 11/4044* (2013.01); *A47L 1/05* (2013.01)

(58) Field of Classification Search
CPC .... A47L 11/4044; A47L 11/34; A47L 11/1088
See application file for complete search history.

(56) References Cited

U.S. PATENT DOCUMENTS 3,107,387 A 10/1963 Sam
3,584,330 A 6/1971 Wallin et al.
5,067,199 A * 11/1991 Alazet ..... A47L 11/30 15/320
5,603,139 A * 2/1997 Alazet ..... A47L 1/08 15/320
5,761,762 A 6/1998 Kubo

FOREIGN PATENT DOCUMENTS

EP 0 422 977 A1 4/1991
GB 2 014 439 A 8/1979

* cited by examiner

*Primary Examiner* — Dung Van Nguyen
(74) *Attorney, Agent, or Firm* — Andrew W. Chu; Craft Chu PLLC

(57) ABSTRACT

A suction device sucks air and liquid from a planar surface, and the scraper blade active portion moves on a surface. The active portion is in the form of a single blade, made from a flexible or semi-rigid material, intended to be moved in one direction against the planar surface. There is an internal cavity connected to a mechanism for sucking air and liquid. At a distal portion of the blade and behind the ridge to be moved on the surface, two walls together form an angle and meet at the ridge. A first wall is presented first towards the surface to be scraped during a scraping operation having, alongside and close to the ridge, a plurality of holes opening into the cavity.

12 Claims, 4 Drawing Sheets

SUCTION DEVICE DESIGNED TO SUCK AIR AND LIQUID FROM A PLANAR SURFACE, AND SCRAPER BLADE FOR SUCH A DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a suction device designed capable of sucking air and liquid from a planar surface, and more particularly to the active part of said suction device intended to be moved on said surface.

The present invention is more particularly related to the field of scrapers for cleaning planar surfaces such as glazed surfaces, using suction to remove residual cleaning water.

The present invention is however not limited to this use and may very well be applied to the cleaning of surfaces other than glazed surfaces.

On the other hand, the active part of the suction device according to the invention can be associated on said device with ancillary means for treating the surface to be cleaned, whether they are cleaning means such as a wipe for example, and/or means for projecting cleaning liquid or steam.

2. Description of Related Art Including Information Disclosed Under 37 CFR 1.97 and 37 CFR 1.98.

These scrapers generally include a flexible scraper blade associated with an active suction means at the level of the lower edge of said blade. Such cleaning devices are already known, namely those described in WO2010018312 for example, or in WO2009086891.

The suction can be carried out in different ways, such as for example between two blades forming a suction mouth, or through a textile wipe arranged under a scraper blade and in which the residual water is collected.

The scraping operation consists in moving the scraper on the planar surface by a succession of more or less rectilinear movements, preferably from top to bottom when said surface is vertical. Irrespective of the device being considered, the user always faces the same problem, the remaining of a mark of residual water at the end of the path of the scraper. This is essentially due to the fact that the angle the scraper blade forms with the planar surface is not constant, but increases, and that the mouth through which the suction occurs is therefore not optimally shaped.

Thus, as can be seen in the attached FIG. 1, in the case of a mouth A made of two blades B and C forming an angle between them so as to join each other on a line of contact with the surface S to be treated, the deformation of the blades B and C when they are applied against said surface S causes the withdrawal of the blade B in front of the surface S, with respect to the other blade C, and this distance will generate, at the end of the path, a small stream of water F, which will not be sucked. The higher the pressure, the larger will be the deformation and the larger will also be the stream of water.

On the other hand, upon application against the surface to be treated, the two blades B and C deform and come close to each other, which restricts the suction capacity and which requires notches, not shown, permitting the passing through of said liquid to be created on the edge of the blade that first enters into contact with the residual liquid.

Furthermore, in the case of two blades, a loss of suction is observed at the ends of the space separating the two blades.

Also, in the case of a wipe collecting residual liquid, when at the end of the path the device is separated from the planar wall, the wipe leaves a trace, even though it is a minimum trace, despite the carrying out of a suction through the latter.

Also known are scrapers, which comprise a single blade drilled with channels ending behind the scraping ridge, and which are intended to evacuate water under the action of a negative pressure. Such a scraper is described in EP 0 422 977, where the channels are extended by pipes. The disadvantage of this type of scraper, besides the fact that the channels can easily become clogged, is that by capillary action water tends to cling to the walls of the channels, so as to require a high negative pressure, and therefore a more powerful motorization with all the consequences this involves, namely a higher consumption, a higher weight, etc.

SUMMARY OF THE INVENTION

The object of the present invention is to cope with the various aforesaid drawbacks by providing a suction device permitting to clean a planar surface while leaving as few traces as possible, irrespective of the direction in which the movement occurs.

The suction device according to the invention, designed capable of sucking air and liquid from a planar surface, and more in particular the active part of the scraper blade type intended to be moved on said surface, is characterized in that said active part is in the form of a single blade, made of a flexible or semi-rigid material, intended to be moved in one direction against said planar surface, and which includes an internal cavity connected to a means for carrying out said suction of air and liquid, and is delimited at the level of the distal portion of said blade, behind the ridge intended to be moved over said surface, by two walls forming an angle between them and which join each other at the level of said ridge, the wall intended to be presented first to said surface to be scraped during a scraping operation having, along and close to said ridge, a plurality of holes that end in said cavity.

The present invention also relates to a suction device, according to the invention, designed to suck air and liquid from a planar surface, and more particularly to the active part of the scraper blade type intended to be moved on said surface, which is characterized in that said active part is in the form of two blades made of a flexible or semi-rigid material, arranged so as to form an angle between them and to join each other according to a ridge at the level of which they are made integral through gluing, welding or otherwise, in order to form only a single blade intended to be moved in one direction against said planar surface, and in that it includes an internal cavity resulting from the angled positioning and from making one of said two blades integral with the other one, said cavity being connected to means for carrying out said suction of air and liquid, and in that the blade of one of said two blades, intended to be presented first to said surface to be scraped during a scraping operation, has along and close to said ridge, a plurality of holes that end in said cavity.

According to a variant, irrespective of the embodiment being considered, the active part of the scraper blade type has, on each of the two blades or walls, on both sides and close to the ridge, a plurality of holes ending in the cavity.

Such a variant permits to scrape and suck during a scraping performed in both directions of movement of the active part on the surface to be scraped.

Irrespective of the embodiment, the scraper blade includes no channels or tubes likely to be clogged or to limit the suction capacities.

According to an additional feature of the suction device according to the invention, the holes each have a chamfer on the outside.

According to another additional feature of the suction device according to the invention, the cavity is provided with reinforcing means extending between the two walls or blades, guaranteeing that it will not be crushed.

According to another additional feature of the suction device according to the invention, the reinforcing means consist of elements applied against, inserted between the two walls or blades.

According to another additional feature of the suction device according to the invention, the applied reinforcing elements are in the form of at least one part comprising a plurality of parallel walls each intended to extend between the two walls or blades, and all of them connected by at least one longitudinal beam.

Advantageously, this part is made of a more rigid material than that of which the walls or blades are made, so as to facilitate its placing between the latter.

According to another additional feature of the suction device according to the invention, the part incorporates non-return means designed capable of trapping the residual water from the suction.

According to another additional feature of the suction device according to the invention, each of the non-return means consists of a truncated channel permitting the communication between one hole among the plurality of holes and the internal cavity connected to the means for performing the suction of air and liquid.

According to another additional feature of the suction device according to the invention, the free end of the blade, intended to be moved into contact with the planar surface to be treated, has a flat strip towards which the two faces of said blade converge, while the surface that faces the portion of said planar surface to be treated has a set-back forming an angle with said strip, said set-back being extended by a portion of a wall sloping with respect to the general plane of the blade, and in which portion the holes are located.

According to another additional feature of the suction device according to the invention, the holes are made in the distal edge of the wall or blade intended to be turned towards the surface to be scraped, and are separated two-by-two by a strip of material that has on the distal side a substantially triangular shaped end the tip of which forms the point of attachment to the other wall or blade.

The present invention also relates to a scraper blade for a suction device as defined above.

The advantages and features of the suction device of the invention will clear appear from the following description, which refers to the attached drawing, which represents several non-restrictive embodiments.

DETAILED DESCRIPTION OF THE DRAWINGS

Figure 1:
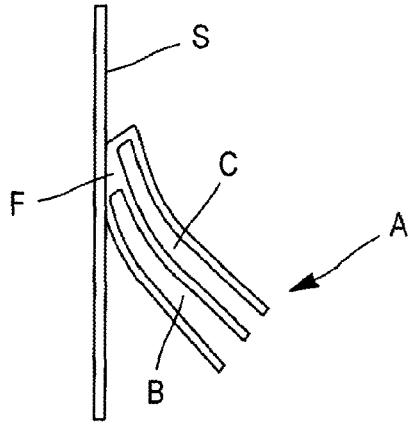
FIG. 1 PRIOR ART
FIG. 1 shows a schematic, partial and cross-sectional view of a portion of a suction device of a known type.
Figure 2:
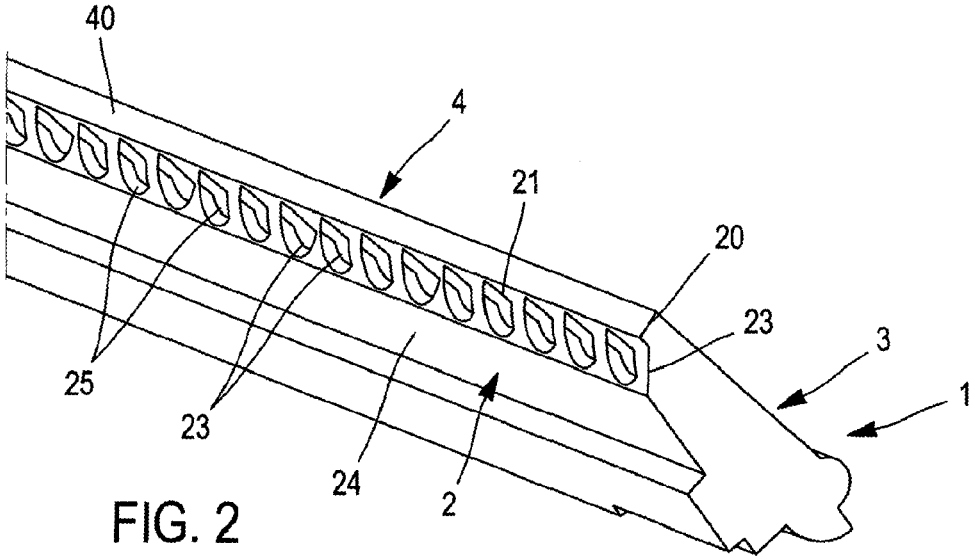
FIG. 2 shows a schematic, partial and perspective view of a portion of a suction device according to the invention.
Figure 3:
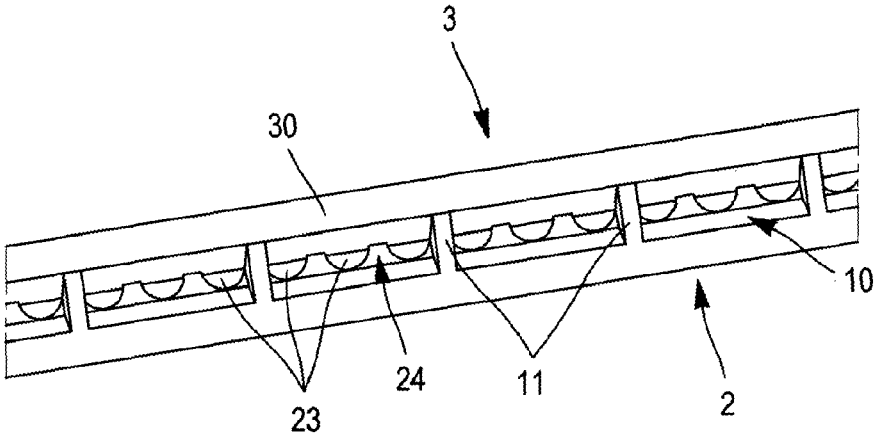
FIG. 3 shows a schematic, partial and perspective view of the same portion according to another angle.
Figure 4:
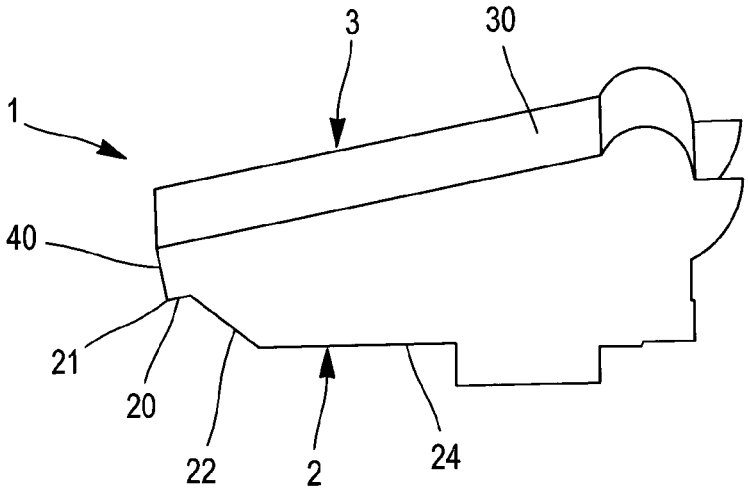
FIG. 4 shows a schematic, partial perspective view of the same portion according to another angle.

The present invention relates to a suction device, not shown, designed capable of sucking air and liquid from a planar surface, the active part 1 of which intended to be moved over said surface can be seen in FIGS. 2, 3 and 4.

This active part 1 consists of a scraper blade of a special design, made of a flexible or semi-rigid material.

In the embodiment shown, the blade 1 has a cross-section with a globally wedge- or whistle-shape, which includes two surfaces, and namely a surface 2 facing the portion of the planar surface to be scraped, and a surface 3 on the other side.

Its free end 4, intended to be moved into contact with the planar surface to be treated, has a flat strip 40, towards which the panels 2 and 3 converge, and which is substantially perpendicular to the general plane of the blade 1. While the surface 3 is planar, the surface 2 has a particular profile, namely the junction of the flat strip 40 with the surface 2 occurs through a set-back 20 the plane of which forms an angle, preferably a closed angle, with the plane the strip 40, so as to form a ridge 21, this set-back 20 being extended by a sloping wall 22 in which are formed holes 23, visible in FIGS. 2 and 3.

The strip 40 results from the thickness of the blade 1 at its free end 4, which provides the latter the strength necessary for performing the scraping by the set-back 20.

The holes 23 are aligned along and behind the ridge 21, and end into an internal cavity 10 in the blade 1, shown in FIG. 3, this cavity 10 connecting with means for creating a negative pressure, not shown. These holes 23 are intended at sucking the residual water scraped by the set-back 20, and more particularly its ridge 21.

The wall 22 is inclined relative to the general plane of the blade 1, this inclination is intended to permit the holes 23 to be oriented so as to obtain an optimal suction, therefore the angle of inclination can be chosen depending on several parameters, such as for example the flexibility of the blade 1, allowed by the characteristics of the material being used.

The cavity 10 forms, immediately behind the holes 23, a widening that releases the passage and avoids slowing down the air flow-rate due to the capillary action of the water on the walls.

It should be noted that the cavity 10 includes reinforcements 11 extending between the walls 24 and 30, which form the two surfaces 2 and 3, respectively, so as to avoid, during a scraping operation, the crushing of the cavity 10.

As can be seen more clearly in FIG. 2, the holes 23 have on the outer side a chamfer 25, which permits to eliminate the angles likely to retain water by capillary action.

In use, the set-back 20 scrapes the residual water, which is sucked through the holes 23. The suction remains optimal, irrespective of the state of deformation of the blade 1.

Figure 5A:
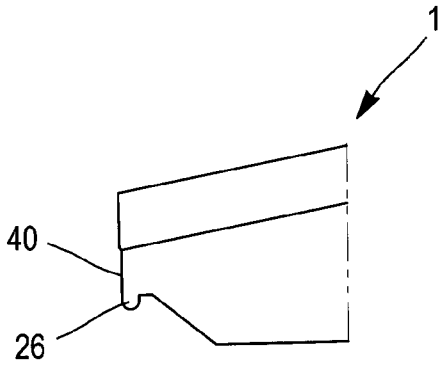
FIGS. 5*a* and 5*b* show schematic, partial and perspective views of variants of the same portion.
Figure 5B:
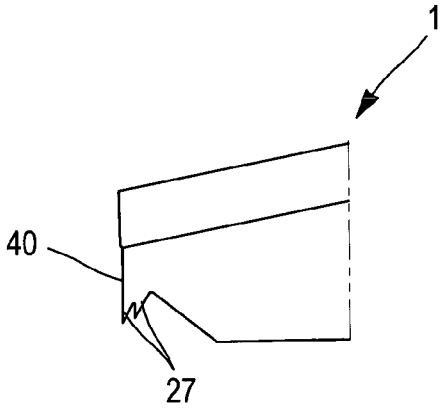

It should be noted that the shape of the set-back 20 may have different profiles, both at the level of its angle or of its cut, so that its scraping ridge is extended by an extension 26 the end of which has a rounded cross-section, as can be seen in FIG. 5*a*, or which may include several parallel or substantially parallel extensions 27 the ends of which constitute as many ridges, as can be seen in FIG. 5*b*, so as to create several successive levels of scraping, whereby the choice these variants can depend on the application the blade 1 is intended for.

Figure 6:
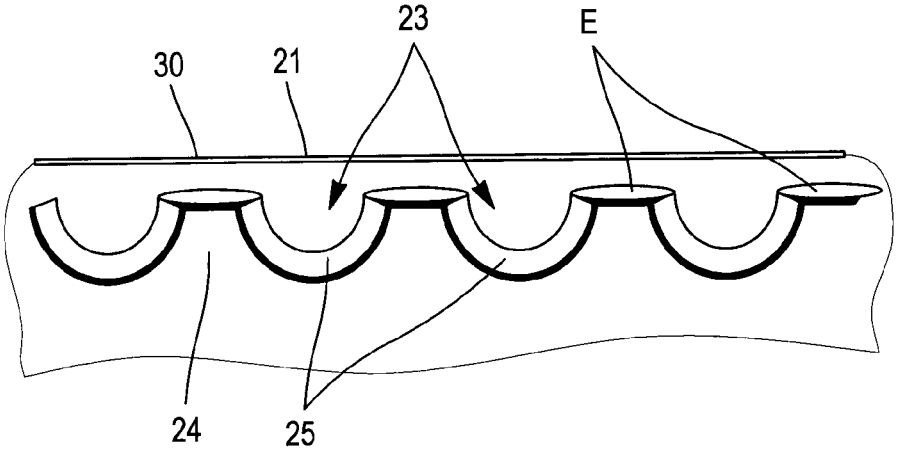
FIG. 6 shows a schematic partial view of the same portion in use.

When referring now to FIG. 6, it can be seen that, schematically, during the use of the scraper, even if the chamfer 25 of the holes 23 permits to limit the capillarity action, water R can stagnate on the wall 24, between two successive holes 23, and this can result into traces of water remaining on the cleaned surface.

Figure 7:
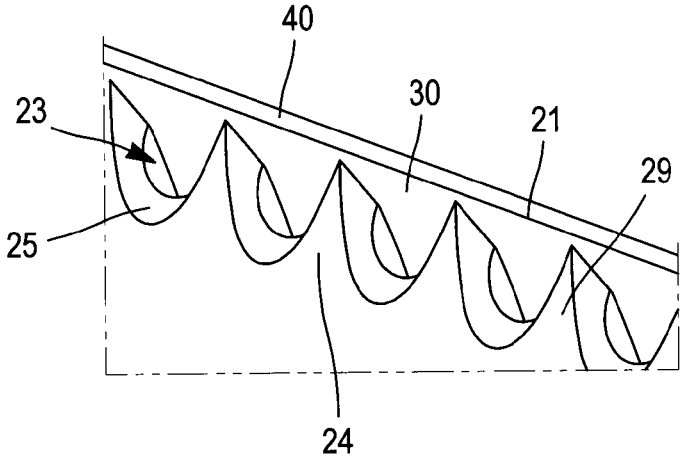
FIGS. 7 and 8 show schematic, partial and perspective views of a preferred embodiment of the same portion.
Figure 8:
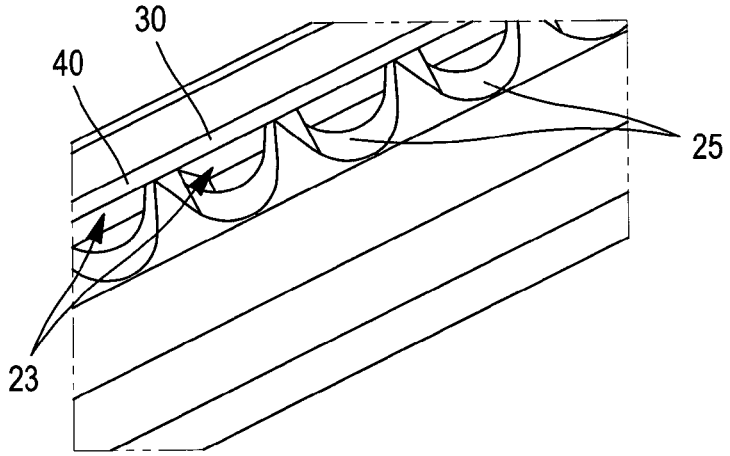

Therefore, in order to cope with this drawback, a preferred embodiment is provided, which is shown in FIGS. 7 and 8.

In these figures, it can be seen that the holes 23 are separated two-by-two by a strip of material 29, which is part of the wall 24 and which has, at the level of its junction with the wall 30, a pointed shape oriented towards the ridge 21, and the chamfer 25 of the orifices of the holes 23 is extended along the strip of material 29.

Figure 9:
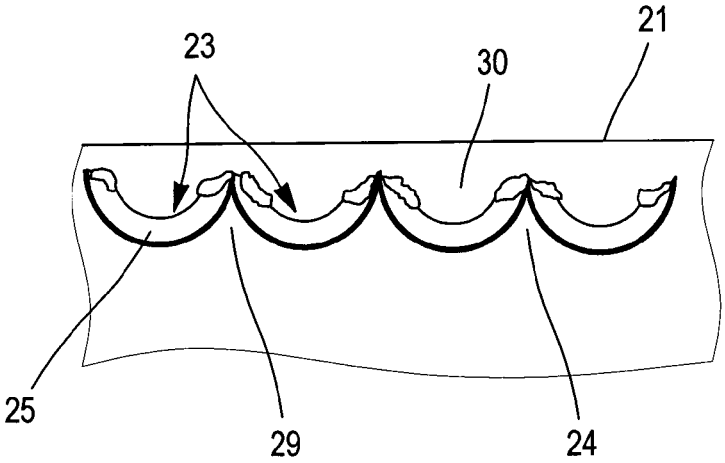
FIG. 9 shows a schematic partial view of the same portion in use.

When referring now to FIG. 9, it can be seen that there remains no unevenness likely to retain water.

This embodiment allows a nearly perfect cleaning. In addition, due to the result obtained, it is possible to reduce the necessary suction power, which reduces the weight of the device, which makes its use even easier in the case of a hand-held device such as a scraper for example.

From the viewpoint of the manufacture of this embodiment, the walls 24 and 30 may be molded in one single piece, but preferably, they constitute two blades assembled by gluing or welding.

Figure 10:
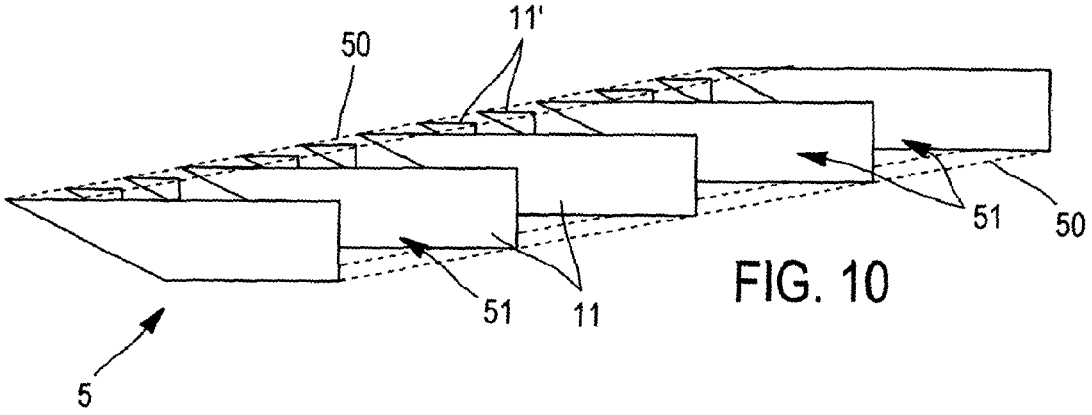
FIG. 10 shows a schematic, partial and perspective view of a portion of the same suction device, in a particular embodiment.

According to a particular embodiment, the reinforcements 11 are applied in the blade 1, that is, as can be seen in FIG. 10, they are connected to each other in order to form a movable part 5 intended to be inserted into a casing formed by the walls 24 and 30, not visible.

The reinforcements 11 are arranged parallel to each other, are connected by longitudinal beams 50, shown in broken lines, and delimit a space 51 two by two.

It should be noted that the presence of reinforcements 11' of reduced dimensions, two in number between two successive reinforcements 11 each intended to be intercalated between two holes 23.

Such a construction advantageously permits to simplify the construction of the blade 1 and namely the mold permitting its manufacture.

Figure 11:
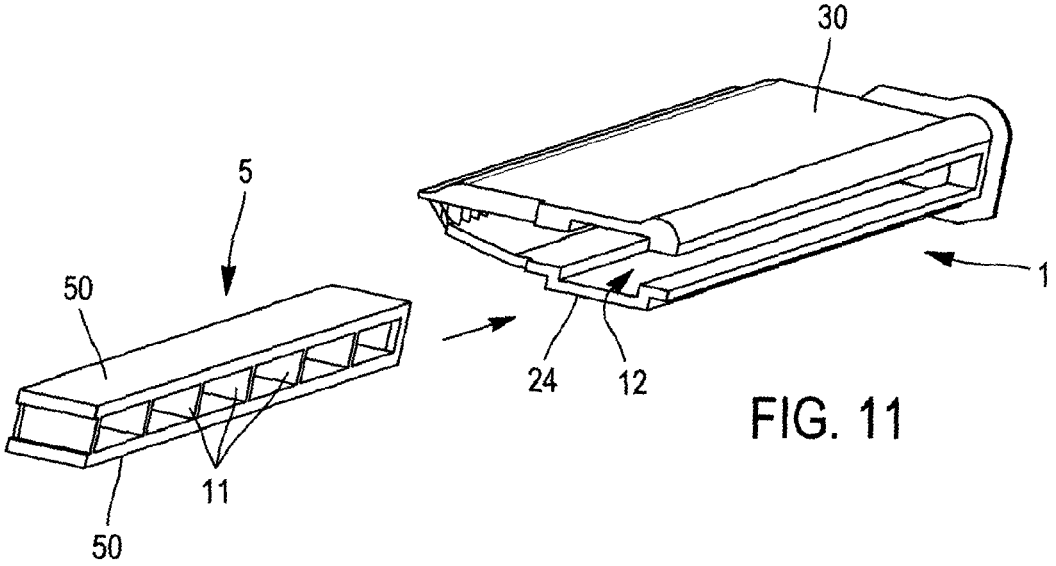
FIG. 11 shows a schematic, partial, perspective and exploded view of the same portion of the same suction device, in another particular embodiment.

Thus, when referring now to FIG. 11, we can see a part 5 comprising two longitudinal beams 50 and reinforcements 11 about to be assembled with the body of the blade 1 by being inserted between the walls 24 and 30 of the latter, in a cavity 12 provided for this purpose.

In addition, this eventually permits this part 5 to be made of a material with different properties, namely rigidity.

Figure 12:
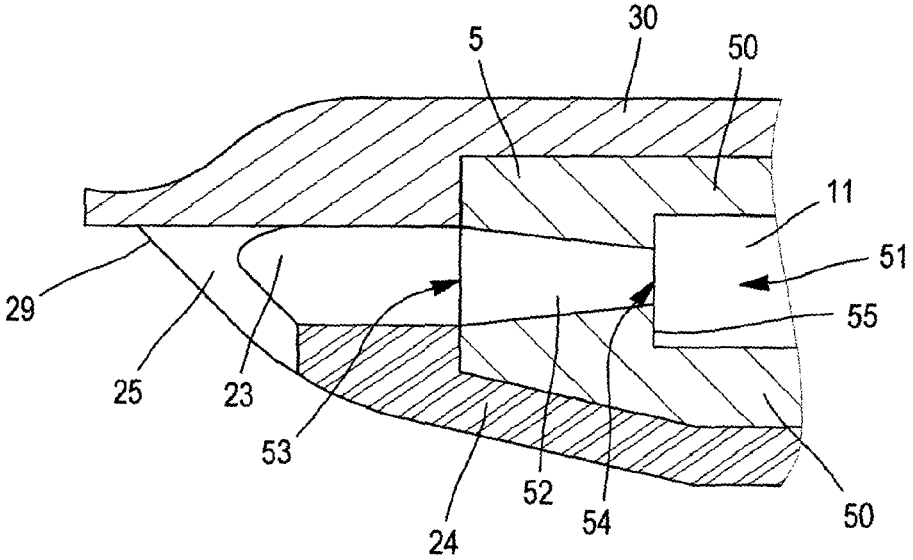
FIG. 12 shows a schematic, partial and cross-sectional view of the same portion in another particular embodiment.

When referring now to FIG. 12, we can see in a variant a more complex blade 1, which includes a non-return device for the sucked residual water. Thus, each of the holes 23 communicates with a space 51 via a non-return element consisting of a truncated channel 52 formed in the part 5 and the largest orifice 53 of which opens into the hole 23 and has a substantially equal diameter, while its smallest orifice 54 opens in a wall 55 into the space 51.

It will be understood that the sucked residual water is thus trapped in the spaces 51 and cannot return through the channels 52.

I claim:

1. A suction device for sucking air and liquid from a planar surface, said suction device comprising:

a single blade, being comprised of a flexible material and moveable in one direction against said planar surface, the blade having a distal portion in contact with said planar surface during a scraping operation, the blade comprising:

an internal cavity being positioned on said distal portion and being comprised of a contact wall and an upper wall, said upper wall being angled toward said contact wall; and means for carrying out suction of air and liquid connected to said internal cavity;

a ridge between said contact wall and said upper wall and being moveable over said planar surface; and a plurality of holes connected to said internal cavity and positioned on said contact wall, said ridge being between said holes and said upper wall, said holes being arranged along said ridge.

2. The suction device according to claim 1, further comprising: another plurality of holes on both sides of said internal cavity, said ridge being between said another plurality of holes and said upper wall, said another plurality of holes being arranged along said ridge.

3. The suction device according to claim 1, wherein each hole has a chamfer on a respective outer side.

4. The suction device according to claim 1, wherein said internal cavity is provided with reinforcing means extending between two sides of said internal cavity.

5. The suction device according to claim 4, wherein the reinforcing means comprises applied elements inserted between said two sides of said internal cavity.

6. The suction device according to claim 5, wherein said applied elements are comprised of a plurality of parallel walls, each parallel wall extending between said two sides of said internal cavity and connected by at least one longitudinal beam.

7. The suction device according to claim 6, further comprising: non-return means trapping residual water resulting from suction, said non-return means being incorporated with said internal cavity.

8. The suction device according to claim 7, wherein each non-return means comprises a truncated channel in fluid communication with at least one hole of said plurality of holes, said internal cavity being connected to said means for carrying out suction of air and liquid.

9. The suction device according to claim 1, further comprising: a flat strip on a free end of the blade, said flat strip at said distal portion of the blade, said contact wall having a set-back forming an angle with said flat strip, said set-back being extended by a portion of a wall sloping with respect to the blade, said plurality of holes being located in said portion of said wall.

10. The suction device according to claim 1, wherein the holes are formed in a distal edge of said contact wall and are separated two-by-two by a strip of material having a substantially triangular shaped end on a distal side, wherein a tip of said strip of material is directed towards said ridge so as to form a point of attachment to said upper wall.

11. A suction device for sucking air and liquid from a planar surface, said suction device comprising:

two blades, each blade being comprised of a flexible material, said two blades being made integral in order to form a single blade member moveable in one direction against said planar surface;

a ridge formed by said two blades joining together at an angle;

an internal cavity being between said two blades and having a shape resulting from angled positioning and from making said two blades integral; and means for carrying out suction of air and liquid connected to said internal cavity, wherein one blade of said two blades is oriented downward relative to the other blade of said two blades so as to be presented first to said planar surface during a scraping operation, said one blade having a plurality of holes along and close to said ridge, said holes being in fluid connection to said internal cavity.

12. A suction device for sucking air and liquid from a planar surface, said suction device comprising:

a single blade, being comprised of a flexible material and moveable in one direction against said planar surface, the blade having a distal portion in contact with said planar surface during a scraping operation, the blade comprising:

an internal cavity being positioned on said distal portion and being comprised of a contact wall and an upper wall, said upper wall being angled toward said contact wall; and means for carrying out suction of air and liquid connected to said internal cavity;

a ridge between said contact wall and said upper wall and being moveable over said planar surface;

a plurality of holes connected to said internal cavity and positioned on said contact wall, said ridge being between said holes and said upper wall, said holes being arranged along said ridge; and a flat strip on a free end of the blade, said flat strip at said distal portion of the blade, said contact wall having a set-back forming an angle with said flat strip, said set-back being extended by a portion of a wall sloping with respect to the blade, said plurality of holes being located in said portion of said wall.

* * * * *